US005767619A

United States Patent [19]

Tsai et al.

[11] Patent Number: 5,767,619

[45] Date of Patent: Jun. 16, 1998

[54] COLD CATHODE FIELD EMISSION DISPLAY AND METHOD FOR FORMING IT

[75] Inventors: Chun-Hui Tsai; Ching-Yuan Lin, both of Hsinchu; Tzung Zu Yang, Pingtung, all of Taiwan

[73] Assignee: Industrial Technology Research Institute, Hsin-Chu, Taiwan

[21] Appl. No.: 573,096

[22] Filed: Dec. 15, 1995

[51] Int. Cl.[6] ..... H01J 1/02

[52] U.S. Cl. ..... 313/495; 313/309; 313/336; 313/351

[58] Field of Search ..... 313/309, 336, 313/351, 495

[56] References Cited

U.S. PATENT DOCUMENTS

| | | | |
|---|---|---|---|
| 3,789,471 | 2/1974 | Spindt et al. | 29/25.17 |
| 4,940,916 | 7/1990 | Borel et al. | 313/306 |
| 5,194,780 | 3/1993 | Meyer | 315/169.3 |
| 5,283,500 | 2/1994 | Kochanski | 315/58 |
| 5,541,466 | 7/1996 | Taylor et al. | 313/309 |
| 5,591,352 | 1/1997 | Peng | 216/11 |

*Primary Examiner*—Sandra L. O'Shea
*Assistant Examiner*—Joseph Williams
*Attorney, Agent, or Firm*—George O. Saile; Stephen B. Ackerman

[57] ABSTRACT

A cold cathode field emission display is described. A key feature of its design is that each group of microtips that constitute a pixel is located on the same equipotential surface and a reliable ballast resistor is interposed between the equipotential surface and the cathode line which powers the pixel. An efficient method for manufacturing the display is also described.

12 Claims, 2 Drawing Sheets

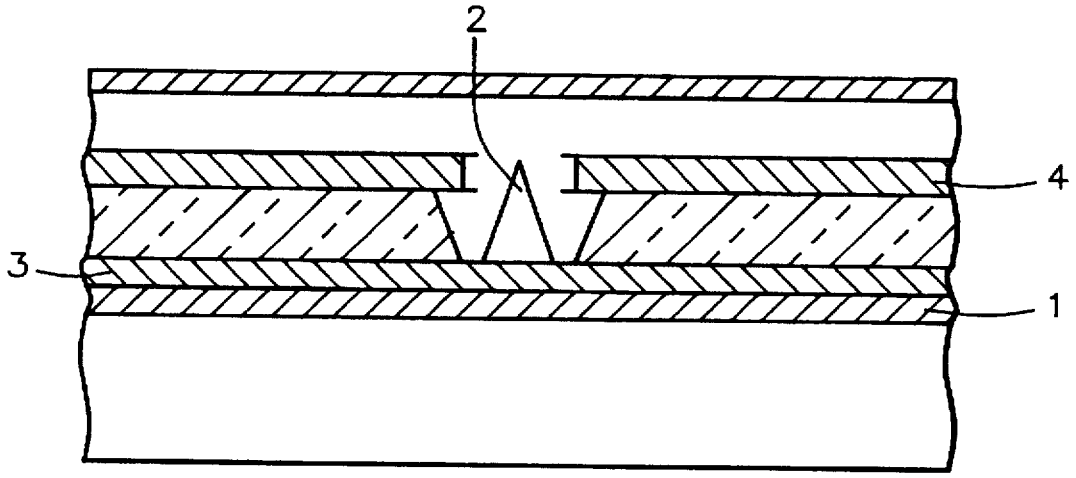
FIG. 1 – Prior Art
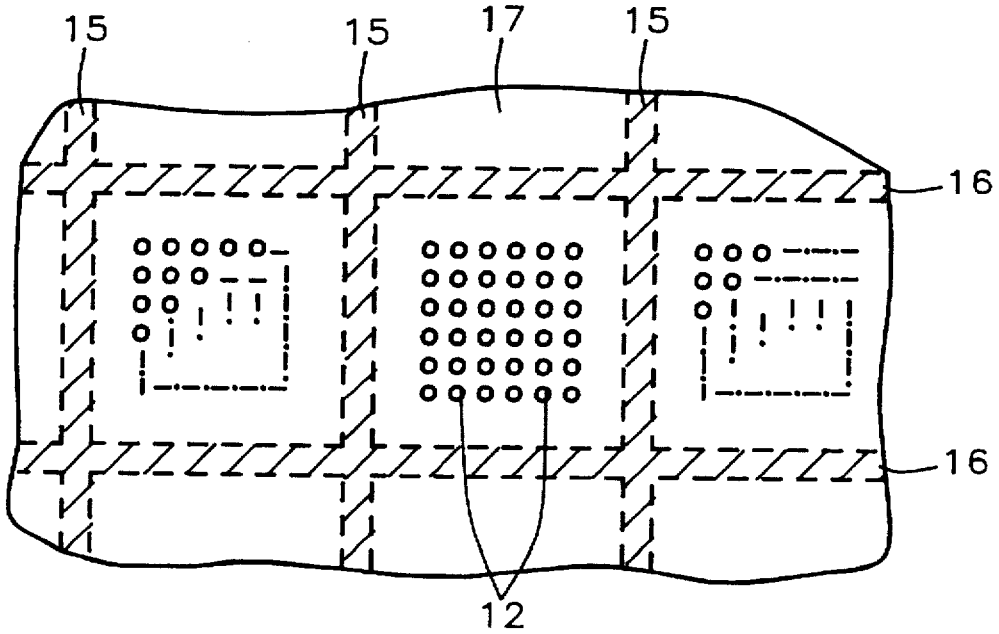
FIG. 2 – Prior Art

COLD CATHODE FIELD EMISSION DISPLAY AND METHOD FOR FORMING IT

BACKGROUND OF THE INVENTION (1) Field of the Invention

The invention relates to cold cathode field emission displays.

(2) Description of the Prior Art

Cold cathode electron emission devices are based on the phenomenon of high field emission wherein electrons can be emitted into a vacuum from a room temperature source if the local electric field at the surface in question is high enough. The creation of such high local electric fields does not necessarily require the application of very high voltage, provided the emitting surface has a sufficiently small radius of curvature.

The advent of semiconductor integrated circuit technology made possible the development and mass production of arrays of cold cathode emitters of this type. In most cases, cold cathode field emission displays comprise an array of very small conical emitters, each of which is connected to a source of negative voltage via a cathode conductor line or column. Another set of conductive lines (called gate lines) is located a short distance above the cathode lines at an angle (usually 90° ) to them, intersecting with them at the locations of the conical emitters or microtips, and connected to a source of relatively positive voltage. Both the cathode and the gate line that relate to a particular microtip must be activated before there will be sufficient voltage to cause cold cathode emission.

The electrons that are emitted by the cold cathodes accelerate past openings in the gate lines and strike an electroluminescent panel that is located some distance above the gate lines. Thus, one or more microtips serves as a sub-pixel for the total display. The number of sub-pixels that will be combined to constitute a single pixel depends on the resolution of the display and on the operating current that is to be used. In general, even though the local electric field in the immediate vicinity of a microtip is in excess of 1 million volts/cm., the externally applied voltage is under a 100 volts. However, even a relatively low voltage of this order can obviously lead to catastrophic consequences, if short circuited.

The early prior art in this technology used external resistors, placed between the cathode or gate lines and the power supply, as ballast to limit the current in the event of a short circuit occurring somewhere within the display. While this approach protected the power supply, it could not discriminate between individual microtips or groups of microtips on a given cathode or gate line. Thus, in situations where one (or a small number) of the microtips is emitting more than its intended current, no limitation of its individual emission is possible. Such excessive emission can occur as a result of too small a radius of curvature for a particular microtip or the local presence of gas, particularly when a cold system is first turned on. Consequently the more recent art in this technology has been directed towards ways of providing individual ballast resistors, either one per microtip or one per group of microtips.

The approach favored by Borel et al. (U.S. Pat. No. 4,940,916 July 1990) is illustrated in FIG. 1. This shows a schematic cross-section through a single microtip. As already discussed, current to an individual microtip 2 is carried by a cathode line 1 and a gate line 4. However, a high resistance layer 3 has been interposed between the base of the microtip and the cathode line, thereby providing the needed ballast resistor. While this invention satisfies the objective of providing each microtip with its own ballast resistor, it has a number of limitations.

The resistivity that layer 3 will need in order to serve as a ballast resistor is of the order of $5\times10^4$ ohm cm. This significantly limits the choice of available materials. Furthermore, sustained transmission of current across a film is substantially less reliable than transmission along a film. The possibility of failure as a result of local contamination or local variations in thickness is much greater for the first case. Consequently, later inventions have focussed on providing ballast resistors wherein current flows along the resistive layer, rather than across it.

Borel's approach is similar to one that was decribed by Spindt et al. in a earlier patent (U.S. Pat. No. 3,789,471 Feb. 15 1974).

The approach taken by Meyer (U.S. Pat. No. 5,194,780 March 1993) is illustrated in FIG. 2. This shows, in plan view, a portion of a single cathode column which, instead of being a continuous sheet, has been formed into a mesh of lines 15 intersecting with lines 16. A resistive layer 17 has been interposed between the mesh and the substrate (not shown here). Microtips 12 have been formed on the resistive layer and located within the interstices of the mesh. A single gate line intersects the cathode line/mesh, and current from the mesh must first travel along resistive layer 17 before it reaches the microtips. A disadvantage of this approach is that the presence of the mesh limits the resolution of the display. Another disadvantage is that the ballast resistance value associated with any particular microtip can vary widely because of the geometry of this design.

Most recently, Kochanski (U.S. Pat. No. 5,283,500 Feb. 1 1994) has described a variety of layout schemes all of which use the same approach as Borel and Spindt (above) i.e. transverse resistors that depend on conduction through a film instead of along it. As already pointed out above, such resistors are inherently unreliable.

We conclude, therefore, that the best design for optimising the variables discussed thus far is that of Meyer. But even in this design, as already noted, the value of the ballast resistance associated with any particular microtip can vary substantially from microtip to microtip. In a recent study, Levine et al. ('Field emission from microtip test arrays using resistor stabilization', Revue "Le vide, les couches minces"—Supplement Supplement au N° 271—Mars-Avril 1994) determined the fraction of the microtips that were actually emitting in an arrangement similar to that described by Meyer (above). They found that in most cases fewer than 9% of the microtips were emitting and frequently this fraction was as low as 3%.

SUMMARY OF THE INVENTION

It is therefore an object of this invention to provide a cold cathode field emission display that includes a separate ballast resistor for each group of field emitting microtips that constitute a sub-pixel.

A further object of the invention is to provide a display wherein almost all of the microtips constituting a pixel emit when the display is operating.

Another object of the invention is that said individual ballast resistors be both robust and reliable.

Still another object of the invention is to provide a display that has high resolution.

Yet another object of the invention is to provide a method for manufacturing a display that satisfies the previous objects at minimum cost.

These objects have been achieved by locating each group of microtips that constitute a sub-pixel on the same equipotential area and interposing a reliable ballast resistor between each of said equipotential areas and the cathode line which powers said sub-pixel.

BRIEF DESCRIPTION OF THE DRAWINGS

FIGS. 1 and 2 illustrate proposed designs in the prior art for providing ballast resistance for the microtips associated with a given pixel of the display.

DESCRIPTION OF THE PREFERRED EMBODIMENTS

Figure 3:
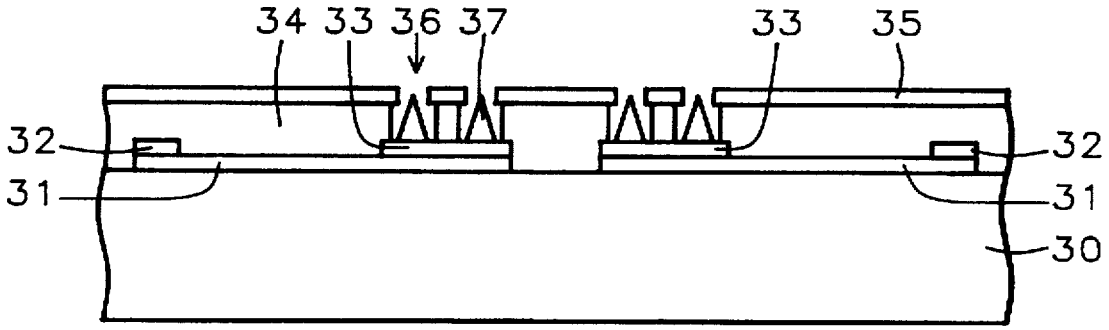
FIGS. 3 and 4 show a cross-section and a plan view, respectively, of several sub-pixels of the display as embodied in the present invention.
Figure 4:
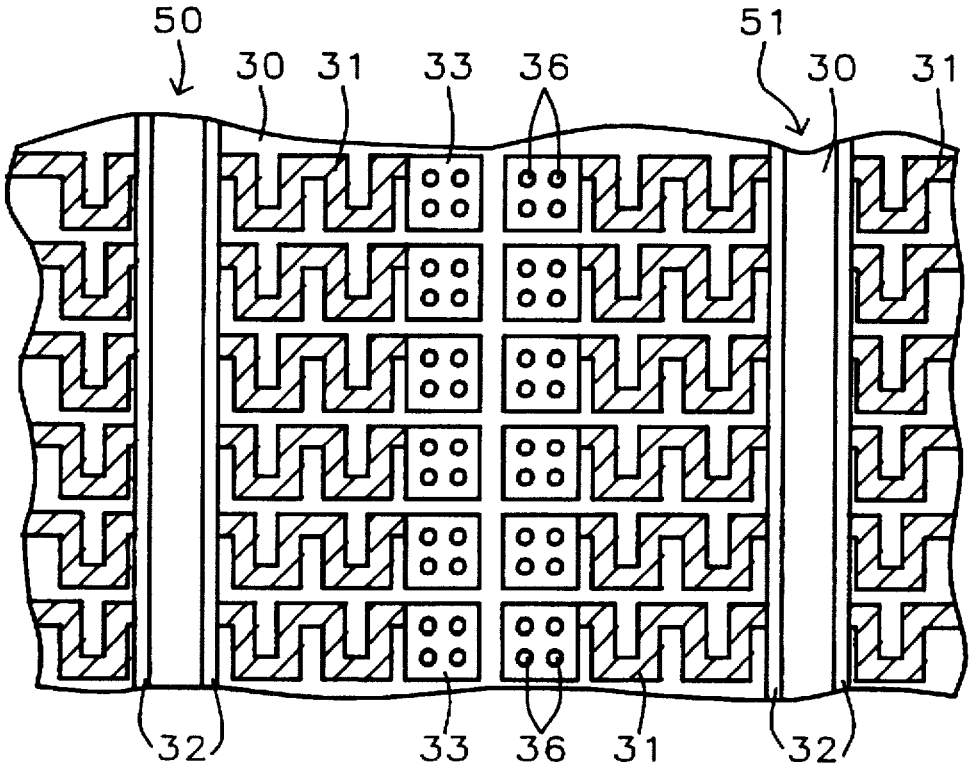

Referring now to FIGS. 3 and 4, we illustrate the main features of the present invention by showing a schematic cross-section and plan view, respectively, of a several sub-pixel cells. Resistive layer 31 has been deposited onto dielectric substrate 30 and then patterned and etched to form serpentine-shaped resistors. Our preferred material for said resistive layer has been silicon but other materials, such as indium tin oxide (ITO) could also have been used without reducing the effectiveness of the present invention.

The thickness of the resistive layer was between about 1,000 and 10,000 Angstrom units, typically about 5,000 Angstrom units, providing a thin film whose sheet resistance was between about 1 and 100 megohms/square. The resistors that were formed as a result of etching the resistive layer into a serpentine shape were typically about 100 megohms but values ranging from about 50 to 500 megohms could also have been used without reducing the effectiveness of the present invention. The choice of these values for the resistors allowed the separation between the two ends of a given resistor to be less than about 10 microns. This made it possible to provide a high resolution display wherein the pitch between adjoining pixels was 10 microns.

In FIG. 4, a cathode column can be seen as the region between 50 and 51. The two conductive bus lines 32 mark the edges of the cathode column. They are separated by substrate material 30. The equipotential areas 33 lie within these two conductive lines and are connected to them through resistors 31. The number of conductive lines 32, and equipotential area 33, in a cathode column (as delineated by 50–51) depends on the design rules and other requirements of the display system.

Following formation of the cathode columns and equipotential areas, dielectric layer 34 is deposited. We have typically used silicon oxide for layer 34 but other materials such as silicon nitride could also have been used without reducing the effectiveness of the present invention.

A second conductive layer 35 of aluminum, molybdenum, niobium, tungsten or polysilicon is then deposited over layer 34 and patterned and etched to form gate lines. While the gate lines are not shown in FIG. 4, said gate lines have a width that is several times that of equipotential areas 33, depending on the number of sub-pixels per pixel, and are oriented to run at right angles to cathode columns 32, overlapping equipotential areas 33. Typicallly the thickness of the gate line layer has been about 3,000 Angstrom units but thicknesses ranging from about 1,000 to 5,000 Angstrom units could have been used without reducing the effectiveness of the present invention.

Following formation of the gate lines, holes, such as 36, were etched through gate lines 35, as well as dielectric layer 34, down to the level of equipotential areas 33. While the figures show only four such holes per equipotential area the actual number of such holes varied, being never less than about two holes per equipotential area.

Cone shaped microtips, such as 37, were then formed, one per opening such as 36. The base of each microtip rests on an equipotential surface while the apex of each microtip is level with gate line 35.

This concludes the description of the present invention and the process for manufacturing it. It is to be understood that additional steps such as providing a fluorescent anode screen, packaging, degassing, etc. still need to be performed, but these are standard in the art and their mode of implementation is not influenced by the present invention.

The effectiveness of the present invention, when compared with prior art such as the design of Meyer, can be seen in the fact that we have measured the average percentage of microtips actually emitting within a pixel and found this to consistently be about 90%

While the invention has been particularly shown and described with reference to the preferred embodiment described above, it will be understood by those skilled in the art that various changes in form and details may be made without departing from the spirit and scope of the invention.

What is claimed is:

1. A cold cathode field emission display comprising:

an insulating substrate;

a plurality of thin film serpentine resistors on said substrate, each resistor having a first end and a second end and a resistance between about 50 megohm and 500 megohms;

cathode columns for said display, formed of parallel spaced conductors on said substrate, contacting the first end of a resistor;

a plurality of equipotential areas on said substrate, each contacting the second end of a resistor;

a dielectric layer on said cathode columns and said equipotential areas;

gate lines on said dielectric layer, formed of parallel spaced conductors, over, and at right angles to, said cathode columns and overlapping said equipotential areas;

a plurality of openings, located at the overlaps of said equipotential areas and said gate lines, passing through said gate lines and through said dielectric layer; and a plurality of groups of cone shaped field emission microtips, each group being in contact with the same equipotential area and each microtip being centrally located within one of the openings, the base of each of said microtips being in contact with one of said equipotential areas and the apex of each microtip being in the same plane as that of said gate lines.

2. The field emission display of claim 1 wherein the material that comprises the thin film resistors is taken from the group consisting of silicon and indium tin oxide.

3. The field emission display of claim 1 wherein said dielectric comprises material taken from the group consisting of silicon oxide and silicon nitride.

4. The field emission display of claim 1 wherein said cathode columns and equipotential areas comprise material taken from the group consisting of aluminum, molybdenum, niobium, tungsten, and polysilicon.

5. The field emission display of claim 1 wherein said gate lines comprise material taken from the group consisting of aluminum, molybdenum, niobium, tungsten, and polysilicon.

6. The field emission display of claim 1 wherein the distance between said first and second ends of one of the resistors is less than about 10 microns.

7. A method for manufacturing a cold cathode field emission display, comprising:

providing a dielectric substrate;

depositing a layer of electrically resistive material, having a sheet resistance between about 1 and 100 megohms per square, onto one surface of said substrate;

patterning and etching said resistive layer to form a plurality of serpentine thin film resistors;

depositing a first layer of electrically conductive material on said layer of electrically resistive material and patterning and etching said first conductive layer to form cathode columns and equipotential areas;

depositing a dielectric layer on said first conductive layer;

depositing a second electrically conductive layer on said dielectric layer and patterning said second conductive layer to form gate lines;

forming openings in said gate lines and said dielectric layer at the overlaps of the equipotential areas and the gate lines, down to the level of the equipotential areas; and forming a plurality of groups of cone shaped field emission microtips, each group sharing the same equipotential area and each microtip being centrally located within one of the openings, the base of each of said microtips being in contact with an equipotential area and the apex of each microtip being in the same plane as that of said gate lines.

8. The method of claim 7 wherein said resistive layer comprises material taken from the group consisting of silicon and indium tin oxide.

9. The method of claim 7 wherein the thickness of said resistive layer is between about 1,000 and 4,500 Angstrom units.

10. The method of claim 7 wherein the thickness of said dielectric layer is between about 10,500 and 15,000 Angstrom units.

11. The method of claim 7 wherein the thickness of said first conductive layer is between about 2,000 and 5,000 Angstrom units.

12. The method of claim 7 wherein the thickness of said second conductive layer is between about 2,000 and 5,000 Angstrom units.

* * * * *